US006260459B1

(12) United States Patent
Peterson

(10) Patent No.: US 6,260,459 B1
(45) Date of Patent: Jul. 17, 2001

(54) MAGNETIZED CRAFTERS TURNTABLE WITH ARMREST

(76) Inventor: Michael E. Peterson, 3025 10th Way, SE. #5, Olympia, WA (US) 98501

( * ) Notice: Subject to any disclaimer, the term of this patent is extended or adjusted under 35 U.S.C. 154(b) by 0 days.

(21) Appl. No.: 09/433,738

(22) Filed: Nov. 4, 1999

Related U.S. Application Data

(60) Provisional application No. 60/109,518, filed on Nov. 23, 1998.

(51) Int. Cl.[7] ..... B26D 7/01

(52) U.S. Cl. ..... 83/451; 83/565; 83/745; 83/454; 30/286; 108/139; 248/118; 269/8

(58) Field of Search ..... 83/451, 565, 454, 83/455; 108/150, 155, 139; 33/DIG. 1, 4, 5, 11, 12, 16, 18.1, 27.12, 42, 485, 489, 549, 562–566; 248/683, 684, 37.3, 37.6, 118, 349.1, 118.1, 346.01, 206.5; 269/1, 8; 30/164, 294, 314, 317, 292, 290, 286

(56) References Cited

U.S. PATENT DOCUMENTS

| | | | | |
|---|---|---|---|---|
| 2,177,905 | | 10/1939 | McKeehan . | |
| 2,432,300 | * | 12/1947 | Ellis | 33/564 X |
| 2,943,336 | * | 7/1960 | Barrett et al. | 269/224 X |
| 3,827,020 | * | 7/1974 | Okamoto | 335/285 |
| 3,949,629 | * | 4/1976 | Johnson | 83/27 |
| 4,476,762 | | 10/1984 | Anderson, III et al. . | |
| 4,739,683 | | 4/1988 | Ogawa . | |
| 4,779,543 | | 10/1988 | Kelley . | |
| 4,861,364 | | 8/1989 | Trujillo et al. . | |
| 4,892,295 | | 1/1990 | Keller . | |
| 4,930,382 | * | 6/1990 | Collins | 83/13 |
| 5,102,288 | | 4/1992 | Kawasaka . | |
| 5,495,671 | | 3/1996 | Shun-Yi . | |
| 5,579,670 | * | 12/1996 | McCormick | 83/56 |

* cited by examiner

*Primary Examiner*—Boyer Ashley
(74) *Attorney, Agent, or Firm*—Richard C. Litman

(57) ABSTRACT

A magnetized craftsman's turntable apparatus has an armrest. A magnet is embedded in the rectangular turntable for holding the metal templet over a paper sheet. The craftsman's arm can be resting on the immovable armrest as the templet is rotated for cutting designs in the paper sheet.

2 Claims, 2 Drawing Sheets

MAGNETIZED CRAFTERS TURNTABLE WITH ARMREST

CROSS-REFERENCE TO RELATED APPLICATION

This application claims the benefit of U.S. Provisional patent application Ser. No. 60/109,518, filed Nov. 23, 1998.

BACKGROUND OF THE INVENTION

1. Field of the Invention

The present invention relates generally to craftsman's turntables. More specifically, the invention is a turntable for cutting designs out of paper with a metal template. The turntable allows for rotation of the paper while cutting. The provision of an armrest makes it unnecessary for the craftsman to have to hover his or her arm over the art work.

2. Description of Related Art

The related art of interest describes various rotatable tables with or without magnetic holding elements. The art of interest will be described in the order of perceived relevance to the present invention.

U.S. Pat. No. 4,861,364 issued on Aug. 29, 1989, to Ted A. Trujillo et al. describes a method for assembling and soldering pieces of stained glass by placing a template to outline a mosaic fit of glass pieces on a workboard by nailing flat sided nails to the outer perimeter on a rectangular workboard attached to a square support plate by hook and latch material strips. The support plate is rotated on a thrust bearing in a base. The apparatus is distinguishable for the omission of a magnetic means and an armrest.

U.S. Pat. No. 4,476,762 issued on Oct. 16, 1984, to Frank T. Anderson, III et al. describes a hydraulically operated cutting die supporting plate apparatus (for cutting envelopes) which contains recessed pairs of bar magnets arranged in a circle to hold the cutting die. The apparatus is distinguishable for lacking an armrest and a hydraulically operated cutting platform configured as in the present invention.

U.S. Pat. No. 4,739,683 issued on Apr. 26, 1988, to Hiromi Ogawa describes an apparatus for cutting a continuously fed material sheet into trapezoidal pieces on a turning table with movable upper and lower cutters. The machine is distinguishable for its automatic operation.

U.S. Pat. No. 5,495,671 issued on Mar. 5, 1996, to Wang Shun-Yi describes a hand operated apparatus for multi-shape cutting of colored paper to form animal cutouts. A circular cutting table assembly with six design cutting means is held within a U-shaped base member with a punching means on one end and the other end functioning as a handle. The device is distinguishable for its lack of an armrest and magnetic holding means.

U.S. Pat. No. 3,949,629 issued on Apr. 13, 1976, to Betty Johnson describes a method of cutting and storing garment-pattern shaped pieces of textile material, wherein magnets and oval metal plates are used to position and clamp the thin paper sheet pattern pieces to the textile cloth. The device utilized is distinguishable for its lack of a turntable and armrest.

U.S. Pat. No. 2,177,905 issued on Oct. 31, 1939, to Louis W. McKeehan describes a holder for drawing paper on a drawing board with a metal plate facing by thick circular magnets in each corner. This holder device is distinguishable for its omission of a separate armrest and a turntable.

U.S. Pat. No. 4,779,543 issued on Oct. 25, 1988, to Daniel Kelley describes a rotatable drafting table having a rectangular configured drafting surface. The rotatable drafting table is distinguishable for the lack of magnets and a separate armrest.

U.S. Pat. No. 4,892,295 issued on Jan. 9, 1990, to Jeanne N. Keller describes a paper sheet holding device for cutting with a pair of scissors along one edge of the device. The device has two square flat blocks hinged at its rear for inserting a paper sheet between the lid and base blocks which have embedded round magnetic disks in each corner. The device is distinguishable for the omission of an armrest and a turntable.

U.S. Pat. No. 5,102,288 issued on Apr. 7, 1992, to Shozo Kawasaka describes a work table for pattern matching of cloth sheets by utilizing an electromagnetizable surface for maintaining metal pins with seats in position. The work table is distinguishable for the lack of a separate armrest and a turntable.

None of the above inventions and patents, taken either singly or in combination, is seen to describe the instant invention as claimed.

SUMMARY OF THE INVENTION

Accordingly, it is a principal object of the invention to provide a craftsman's turntable.

It is another object of the invention to provide a craftsman's turntable with an armrest.

It is a further object of the invention to provide a craftsman's turntable with an armrest for cutting stencils or designs in paper.

Still another object of the invention is Lo provide a craftsman's turntable with an armrest for cutting stencils or designs in paper under a metal pattern or templet held down by a recessed magnet in the turntable.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is directed to a magnetized craftsman's turntable with an armrest for cutting stencils or designs in paper under a metal pattern plate or templet held down by a recessed magnet in the turntable.

Figure 1:
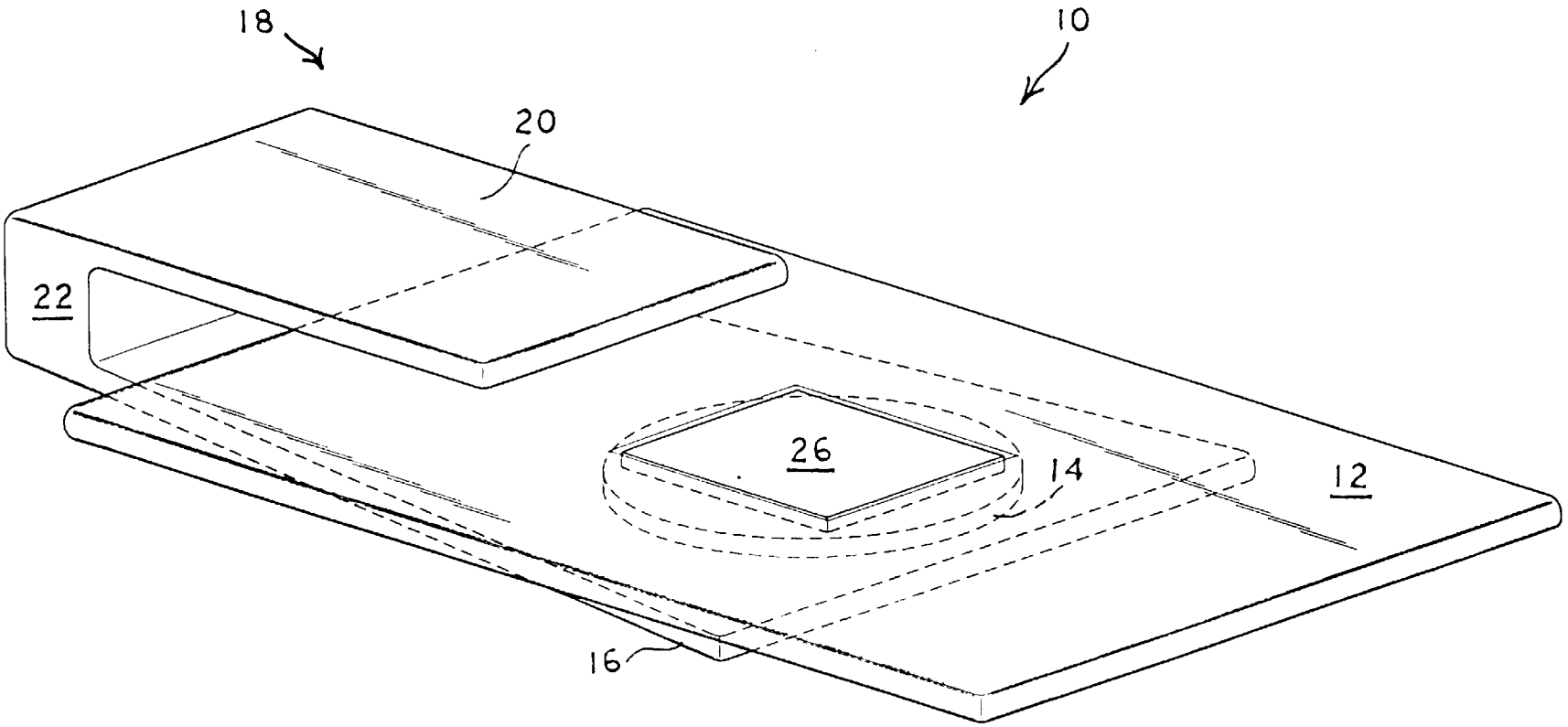
FIG. 1 is a perspective view of a magnetized craftsman's turntable with an armrest according to the present invention.
Figure 2:
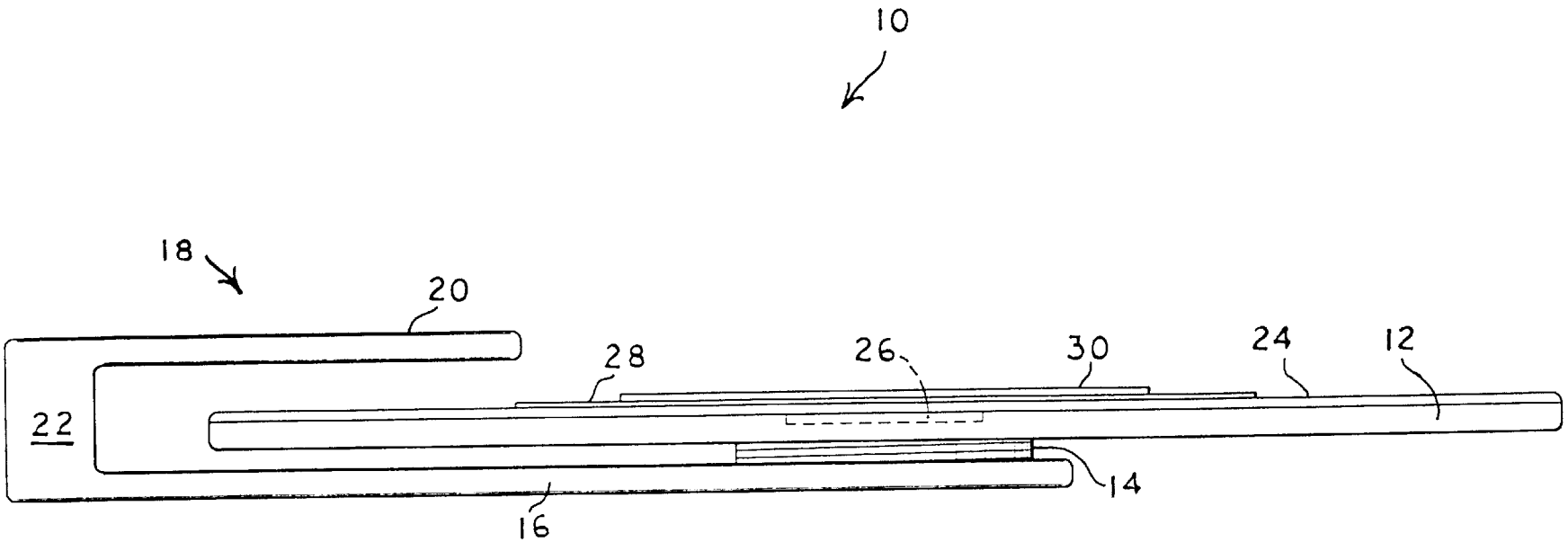
FIG. 2 is a side elevational view of the FIG. 1 device including a metal templet holding down a paper sheet.

In FIGS. 1 and 2, a craftsman's turntable apparatus 10 is shown comprising a rectangular turntable 12, approximately 1 ft. by 1.5 ft., turning on a rotatable circular pedestal 14 positioned on a horizontal trapezoidal shaped base leg 16 of a turntable support 18. Turntable support 18 has an armrest leg 20, approximately 6.75 in. by 9 in. The armrest leg 20 and the base leg 16 are separated by a vertical middle element 22 approximately 2.5 in. high on the outside surface. The corners of the rectangular turntable 12 can be optionally rounded for maximizing the clearance for the rotating turntable. The trapezoidal base leg 16 widens from the middle element 22 of the turntable support 18 to the opposite end, to provide greater support for the turntable 12. The rotatable circular pedestal 14 is located proximate to the distal edge of the horizontal base leg 16.

The turntable 12 has a cut-resistant surface or cutting mat 24. In the center of the turntable 12 a square shaped flat magnet 26 is embedded. When a crafting paper sheet 28 is placed on the turntable 12, a 20 gauge steel templet 30 with a cutout pattern is placed on top of the crafting paper sheet 28. The magnet 26 attracts the steel templet 30 with adequate force to prevent the crafting paper sheet 28 from shifting and causing cutting mistakes.

It should be noted that the apparatus can be used to paint a pattern or design through a metal stencil on a paper sheet and alleviate the strain on a free arm of the artist.

Thus, a craftsman's turntable apparatus has been shown with an armrest for alleviating stress on a free arm, while the craftsman is cutting a pattern in a paper sheet through a steel templet which does not shift due to an embedded magnet in the base of the turntable.

It is to be understood that the present invention is not limited to the sole embodiment described above, but encompasses any and all embodiments within the scope of the following claims.

I claim:

1. A magnetized craftsman's turntable apparatus with an armrest comprising:

a rectangular turntable element having a top surface, a bottom surface and a center;

a cutting mat covering the top surface of said rectangular turntable element;

a square magnet embedded in said rectangular turntable element at the center of the top surface;

a metallic template having a cutout pattern for placement atop a crafting paper sheet positioned on said turntable element;

a turntable element support comprising a rectangular top armrest portion having a proximal and a distal edge, a trapezoidal-shaped base portion having a proximal and a distal edge and being spaced apart from and parallel to said armrest, and a vertical element for connecting said armrest portion along its proximal edge to said base portion along its proximal edge; and a circular rotatable pedestal positioned between said base portion proximate its distal edge and said turntable element at the center thereof.

2. The apparatus according to claim 1, wherein said trapezoidal-shaped base portion has its distal edge wider than its proximal edge.

* * * * *